United States Patent [19]

Hara et al.

[11] Patent Number: 4,598,041

[45] Date of Patent: Jul. 1, 1986

[54] SELF-PROCESSING PHOTOGRAPHIC FILM UNIT WITH DISSOLVABLE TRAP MEMBER

[75] Inventors: Yoshio Hara, Kanagawa; Yoshiaki Ishino, Shizuoka, both of Japan

[73] Assignee: Fuji Photo Film Co., Ltd., Kanagawa, Japan

[21] Appl. No.: 687,285

[22] Filed: Dec. 28, 1984

[30] Foreign Application Priority Data

Dec. 28, 1983 [JP] Japan ..... 58-245571

[51] Int. Cl.[4] ..... G03C 3/00; G03C 5/39

[52] U.S. Cl. ..... 430/498; 430/209; 430/216

[58] Field of Search ..... 430/209, 498, 216; 354/304

[56] References Cited

U.S. PATENT DOCUMENTS

| | | | |
|---|---|---|---|
| 2,686,716 | 8/1954 | Land | 430/209 |
| 2,686,717 | 8/1954 | Land | 430/209 |
| 3,615,436 | 10/1971 | Campbell | 430/209 |
| 3,761,269 | 9/1973 | Campbell | 430/209 |
| 4,042,396 | 8/1977 | Sylvester | 430/209 |

*Primary Examiner*—Richard L. Schilling
*Attorney, Agent, or Firm*—Young & Thompson

[57] ABSTRACT

A self-processing photographic film unit includes a first sheet for recording a positive image, a transparent second sheet bonded to the first sheet in face-to-face relation, a container for a processing liquid coupled to the leading end of the film unit, and a trap coupled to the trailing end of the film unit. Following exposure of the film unit, the processing liquid is distributed uniformly between the sheets, and any excess of the processing liquid from an image-recording area of the first sheet is received in the trap. The trap comprises a bag-like trap cover having a plurality of air orifices and a trap member capable of swelling and solubilizing when in contact with the processing liquid, which is surrounded the trap cover. The trap member is made of a fibrous carboxymethylcellulose sheet or a fibrous carboxymethylcellulose sheet and filter paper bonded to each other by sandwiching a liquid impervious member therebetween. The trap member contains azelaic acid as a neutralization agent and a material discharging metal cations as a coagulation agent.

13 Claims, 3 Drawing Figures

SELF-PROCESSING PHOTOGRAPHIC FILM UNIT WITH DISSOLVABLE TRAP MEMBER

BACKGROUND OF THE INVENTION

1. Field of the Invention

This invention relates to self-processing photographic film units, and more particularly to a self-processing photographic film unit which has an improved trapping mechanism adapted to capture any excess of a processing liquid when distributed therein.

2. Description of the Prior Art

A self-processing photographic film unit (which is hereunder referred to as a film unit) is generally called a monosheet-type instant photographic film. Such monosheet-type instant photographic films as made by Eastman Kodak Company and Polaroid Corporation are typical commercial products. As shown in FIG. 1, such film units, which are different in their layered structures and processing mechanisms according to types, have two separate rectangular sheet members, namely, a first sheet member 1 including an image-receiving layer and a second, transparent sheet member 2 which may assist to form a processing liquid layer to the desired thickness when distributed between the sheet members. The first and second sheet members 1 and 2 are superimposed in face-to-face relation and bonded to each other along their marginal portions by a bonding member 3 such as an intermediate sheet member or tapelike members. When the film unit is exposed, the light rays incident thereupon strike the first sheet member 1 after passing through the second, transparent sheet member 2.

The film unit includes a rupturable container means 4 for holding a predetermined amount of processing liquid therein and a trap means 5 for capturing an excess of processing liquid from the image-receiving sheet member 1, which are located along the leading and trailing ends, respectively, of the assembled first and second sheet members 1 and 2. The container means 4 is adapted to rupture when subjected to external compressive pressure. A pressure applying means (not shown) comprising a pair of liquid spreading rolls is mounted in a processing camera for rotation and adapted to apply compressive pressure to the film unit from the leading end to the trailing end thereof as the film unit is moved therebetween. At the beginning of the processing, the container means 4 is ruptured to discharge its liquid contents between the first and second sheet members 1 and 2 of the film unit and then the discharged processing liquid spreads with the movement of the film unit, with any excess being directed into the trap means 5. Once a process has been completed, a positive, visible image appears on the backside of the first sheet member 1 opposite to the second sheet member 2.

The trap means 5, as shown in FIG. 2, includes a trap member comprising fibrous spacer members 9 and 11 between which a liquid-impervious layer 10 is sandwiched, and a bag-like trap cover 7 for enveloping or surrounding the trap member. The trap cover 7 is formed by folding a flap provided at the trailing end of a bonding member 3 and sealing its lateral and end marginal portions onto the second sheet member 2. There are formed in the flap a plurality of tiny orifices 8 through which air taken in the trap means 5 will be released. The fibrous spacer members 9 and 11 serve to capture any excess of the processing liquid therein as well as to maintain the capacity of the trap means 5.

An important problem in the entrapment of processing liquid by the trap means 5 is how to ensure the prevention of leakage of the trapped processing liquid from the trap means 5. In order to solve this problem, one can increase the available capacity of the trap means for capturing the excess processing liquid without any leakage. One solution is to make the trap means thicker so as to increase the physical space for trapping. However, the film units provided with trap means having an increased thickness require that a film pack now commercially available which is designed to accommodate ten sheets of usual film units, accept instead a lesser number, for example eight or nine, of such film units. Furthermore, there is the possibility of such a film unit being able to be withdrawn from the film pack because of the increased friction produced between film units.

SUMMARY OF THE INVENTION

An object of the present invention is to provide a self-processing photographic film unit in which, in order to prevent any leakage of a trapped processing liquid, the trap means is adapted to increase its available trapping capacity without increasing the thickness thereof.

Another object of the present invention is to provide a self-processing photographic film unit in which a trapped processing liquid in the trap means coagulates well.

Still another object of the present invention is to provide a self-processing photographic film in which a trapped processing liquid is neutralized to be unavailable.

BRIEF DESCRIPTION OF THE DRAWINGS

For a further understanding of the nature and objects of the invention, reference should be had to the following detailed description taken in connection with the accompanying drawing, in which like reference numerals designate the same parts throughout the figures thereof and wherein.

DETAILED DESCRIPTION OF THE INVENTION

The present invention is based on the phenomenon that the leakage of a processing liquid is due to the physical properties of the liquid, that is, the lower the viscosity of the processing liquid, the easier it is for the trapped processing liquid to leak. Accordingly, the trap member of the self-processing film unit of the present invention is made of material having the property that the material swells upon contact with the processing liquid and dissolves therein, the mixture thus becoming sludgy. As the materials that can be used can be cited fibrous carboxymethylcellulose or a water-soluble matrix of carboxymethylcellulose with a paper fiber admixed therewith.

If the processing liquid can leak from the trap and flow backward to re-enter the image-recording area, defects such as unevenness in development will result.

For preventing such defects, it is preferred to neutralize the trapped processing liquid, thereby to make it unavailable for further reaction even if it leaks and backflows. This may be effected by impregnating the trap member with an azelaic acid.

Furthermore, the processing liquid, when it remains as a liquid in the trap means, tends to leak through the orifices thereof upon the application of external compressive pressure. Therefore, it is also preferred to coagulate the trapped processing liquid for the purpose of the prevention of this leakage. This is effected by impregnating the trap member with metal cations.

Figure 1:
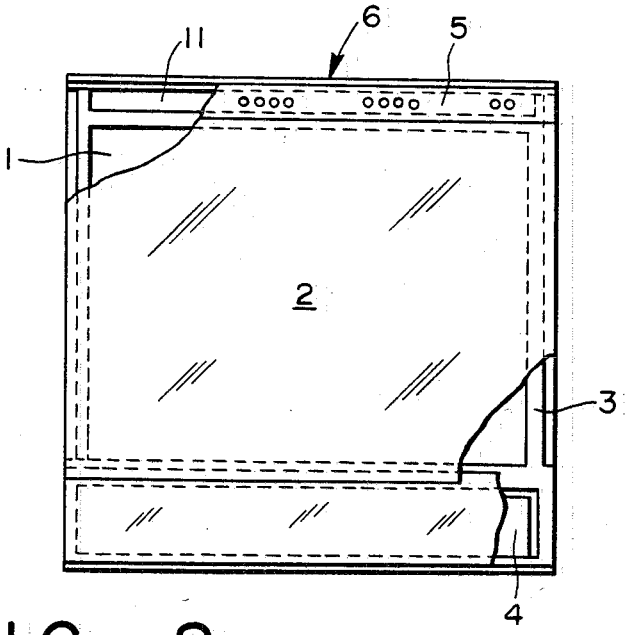
FIG. 1 (PRIOR ART)
FIG. 1 is a plan view showing a conventional self-processing film unit.
Figure 2:
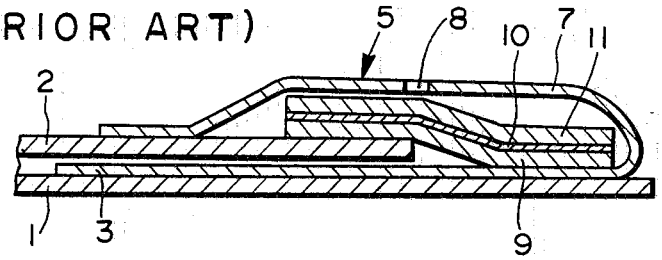
FIG. 2 (PRIOR ART)
FIG. 2 is a longitudinal, sectional view showing a trap means of the self-processing film unit of FIG. 1.
Figure 3:
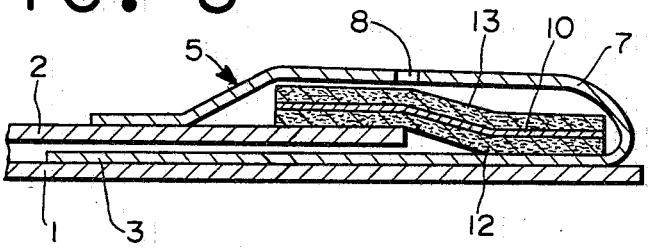
FIG. 3 is a longitudinal, sectional view showing an embodiment of trap means of the present invention.

In FIG. 3 showing an embodiment of the present invention, a trap member comprises a first trap element 12, a second trap element 13 and a liquid-impervious layer 10 sandwiched between the elements 12 and 13. The first trap element 12 can capture the greater part of the excess of the processing liquid. On the other hand, the second element 13 is adapted to capture the remainder, which passes by the liquid-impervious layer 10 and then flows therebehind.

To prevent the leakage of the processing liquid from the trap means, the present invention makes the trapped processing liquid sludgy, which is effected by increasing rapidly the viscosity of the processing liquid trapped in the trap means. For this purpose, it is desirable to employ, as the trap elements 12 and 13, materials which can swell and dissolve upon contact with the processing liquid. As examples of such materials can be mentioned water-soluble polymers of starch, cellulose, tannin and the like, all belonging to natural water-soluble macro-molecular types, or of polyvinyl alcohol, polyethylene oxide, maleic anhydride, phthalate, polyamine and the like, all of the synthetic water-soluble macro-molecular types. Especially preferred is fibrous carboxymethylcellulose of water-soluble cellulose polymer (which is being marketed by Mishima Seishi Co., Ltd. of Shizuoka-ken, Japan under the trade name of "DISSOLVO"). As will be seen from the above description of the material of the trap member, the processing liquid of the present invention must be aqueous and alkaline.

To avoid the leakage of the processing liquid when the trap means is externally pressed, it is desirable to coagulate the trapped processing liquid. Coagulation is performed by denaturing the carboxymethylcellulose, which is a major component of the processing liquid, so as to make it insoluble. For example, the trap elements 12 and 13, impregnated with metal cations, when contacting the processing liquid, can make the carboxymethylcellulose insoluble through the action of the metal cations, thereby coagulating it. As materials releasing metal cations, there can be mentioned metal sulfates, metal nitrates, chloride compounds of metals and organic compounds of metals. Specific examples of such materials are aluminum sulfate, barium chloride, chromium nitrate, stannous or stannic chloride, silver nitrate, ferrous or ferric chloride, ferrous or ferric sulfate, lead sulfate, lead acetate, ethylene diamine tetraacetate aluminum and the like.

A description will be given hereunder, of the preferred embodiment of the present invention.

EXAMPLE 1

The first trap element 12 (of 400 $\mu$ thickness, 5 mm width and 89 mm length) was made of a water-soluble paper "DISSOLVO" impregnated with azelaic acid so as to show 1.0 g equivalent per $m^2$ of neutralization capacity and, on the other hand, the second trap element 13 was made of a filter paper Toyo Roshi No. 2 of 250 $\mu$ thickness (which is the trade name of filter papers marketed by Toyo Roshi Co., Ltd.) These trap elements 12 and 13 were bonded to each other by sandwiching a liquid-impervious member 10 of 50 $\mu$ thickness of a vinyl acetate adhesive, providing a sheetlike trap member which was surrounded by trap cover 7.

Sample film units were preferred and each included a processing liquid with a volume of 0.3 cc at temperature below 20° C. Each film unit was processed for development immediately after it had been left in an atmosphere of air at a temperature of 40° C. and a relative humidity of 80% for two hours. The trap means was then loaded with a weight of 500 g, for examining the leakage of the processing liquid therefrom. Upon examining 20 such film units, two of them showed leakage of the processing liquid.

EXAMPLE 2

In this example, as a first trap member 12, the first element of Example 1 was used, on which 125 g per $m^2$ of aluminum chelate of ethylene diamine tetraacetate was additionally painted so as to be 400 $\mu$ thick. The trap member 12 was bonded to the second trap element 13 through the liquid-impervious member 10 in the same manner as Example 1. The trap member thus prepared was surrounded by the trap cover 7. Such film units were subjected to the same examination as Example 1. As a result of examining 20 such film units, no film unit showed any leakage of the processing liquid.

COMPARED EXAMPLE

Sample film units were made by using trap members of Fotorama F1-10 film units which was the trade name of the instant photographic film marketed by Fuji Photo Film Co., Ltd. and were subjected to the same examination as Example 1. In this compared example, a first spacer member 9 was made of a woven fabric (of 450 $\mu$ thickness, 5 mm width and 89 mm length) impregnated with citric acid and a second spacer member 11 was made of 250 $\mu$ thick Toyo Roshi No. 2 (which was the trade name of filter paper being marketed by Toyo Roshi Co., Ltd.) laminated with polyethylene. Upon examination, five out of 20 film units showed leakage of the processing liquid.

Judging from the comparison of the embodiments of the present invention with the compared example, it will be understood that the present invention produces the effect of preventing the leakage of processing liquid. Especially, the trap means of Example 2, given as an embodiment of the present invention, wherein the trap members are impregnated with a coagulation agent in the form of available metal cations, can prevent the leakage of processing liquid perfectly.

The invention has been described in detail with particular reference to certain preferred embodiments thereof, but it will be understood that variations and modifications can be effected within the spirit and scope of the invention.

What is claimed is:

1. A self-processing photographic film unit comprising:

a first sheet member for recording a positive image thereon;

a second, transparent sheet member;

a bonding member for uniting said first and second sheet members in superimposed relationship;

container means for storing an aqueous alkaline processing liquid therein; and trap means for trapping any excess of said aqueous alkaline processing liquid from an image recording area of said first sheet member, said trap means being gas permeable and including therein a trap member of solid phase absorbent macromolecular material that swells and dissolves upon contact with water.

2. A self-processing photographic film unit as defined in claim 1, wherein said trap member is fibrous carboxymethylcellulose.

3. A self-processing photographic film unit as defined in claim 2, wherein said trap member contains a coagulation agent comprising dischargeable metal cations.

4. A self-processing photographic film unit as defined in claim 3, wherein said trap member contains a neutralizing agent for said excess processing liquid to make the latter non-reactive.

5. A self-processing photographic film unit as defined in claim 4, wherein said neutralizing agent is azelaic acid with which said trap member is impregnated.

6. A self-processing photographic film unit as defined in claim 1, wherein said trap means includes a bag-like trap cover for surrounding said trap members, said trap cover having a plurality of air orifices therethrough.

7. A self-processing photographic film unit as defined in claim 1, wherein said trap member comprises a sheet-like, first trap element of fibrous carboxymethylcellulose, a sheetlike, second trap element of filter paper and a liquid-impervious means to be sandwiched in between said first and second trap elements.

8. A self-processing photographic film unit as defined in claim 7, wherein said trap means includes a bag-like trap cover having a plurality of air orifices therethrough, said trap cover surrounding said trap elements in such a manner that said second trap element is opposite to said air orifices.

9. A self-processing photographic film unit as defined in claim 8, wherein said first trap element is impregnated with azelaic acid.

10. A self-processing photographic film unit as defined in claim 9, wherein said first trap element contains a coagulation agent comprising dischargeable metal cations.

11. A self-processing photographic film unit as defined in claim 10, wherein said coagulation agent is ethylene diamine tetraacetate aluminum.

12. A self-processing photographic film unit as defined in claim 11, in which said ethylene diamine tetraacetate aluminum is painted on said first trap element.

13. A self-processing photographic film unit as defined in claim 12, wherein said liquid-impervious member is a vinyl acetate adhesive.

* * * * *